US010302314B2

(12) United States Patent
Choi et al.

(10) Patent No.: US 10,302,314 B2
(45) Date of Patent: May 28, 2019

(54) INDOOR UNIT OF AIR CONDITIONER

(71) Applicant: LG ELECTRONICS INC., Seoul (KR)

(72) Inventors: Byeonggeol Choi, Seoul (KR); Jungjig Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 15/234,802

(22) Filed: Aug. 11, 2016

(65) Prior Publication Data

US 2017/0045240 A1 Feb. 16, 2017

(30) Foreign Application Priority Data

Aug. 13, 2015 (KR) ..... 10-2015-0114963

(51) Int. Cl.

| | |
|---|---|
| ***F24F 1/00*** | (2019.01) |
| ***F24F 13/20*** | (2006.01) |
| ***F24F 13/08*** | (2006.01) |
| ***F24F 13/22*** | (2006.01) |
| ***F24F 13/30*** | (2006.01) |
| ***F24F 1/0014*** | (2019.01) |
| ***F24F 1/0047*** | (2019.01) |
| ***F24F 1/0003*** | (2019.01) |
| *F24F 1/0022* | (2019.01) |

(Continued)

(52) U.S. Cl.

CPC ..... *F24F 1/0014* (2013.01); *F24F 1/0003* (2013.01); *F24F 1/0047* (2019.02); *F24F 13/08* (2013.01); *F24F 13/222* (2013.01); *F24F 13/30* (2013.01); *F24F 1/0022* (2013.01); *F24F 1/0059* (2013.01); *F24F 1/0063* (2019.02); *F24F 13/20* (2013.01)

(58) Field of Classification Search

CPC ..... F24F 1/0014; F24F 1/0003; F24F 1/0022; F24F 1/0059; F24F 13/08; F24F 13/20; F24F 13/222; F24F 13/30

USPC ..... 454/233

See application file for complete search history.

(56) References Cited

U.S. PATENT DOCUMENTS 3,295,733 A * 1/1967 Heal ..... A45F 5/12 294/142

6,171,540 B1 * 1/2001 Ibaragi ..... B29C 45/00 248/200

(Continued)

FOREIGN PATENT DOCUMENTS

CN 1183533 A 6/1998

CN 101122407 A 2/2008

(Continued)

*Primary Examiner* — Steven B McAllister

*Assistant Examiner* — Allen R Schult

(74) *Attorney, Agent, or Firm* — Dentons US LLP

(57) ABSTRACT

An inside unit of an air conditioner including a cabinet installed at a ceiling of an inside space; a front panel configured to shield the cabinet, and having a suction port through which inside air is suctioned and a panel outlet port through which heat-exchanged air is discharged; a fan provided at an inside of the cabinet; a heat exchanger provided inside the cabinet, and disposed to surround a perimeter of the fan; and a supporting guide installed on the cabinet between the heat exchanger and the fan, and configured to guide the air discharged from the fan to be distributed and discharged toward the panel outlet port.

9 Claims, 8 Drawing Sheets

(51) Int. Cl.
*F24F 1/0059* (2019.01)
*F24F 1/0063* (2019.01)

(56) References Cited

U.S. PATENT DOCUMENTS

| | | | | |
|---|---|---|---|---|
| 2002/0152760 | A1* | 10/2002 | Okuda | F24F 1/0007 62/259.2 |
| 2008/0035317 | A1* | 2/2008 | Choi | F24F 1/0007 165/122 |
| 2009/0025414 | A1* | 1/2009 | Koga | F24F 1/0007 62/263 |

FOREIGN PATENT DOCUMENTS

| | | | | |
|---|---|---|---|---|
| EP | 1 003 002 | A2 | | 5/2000 |
| EP | 1 775 518 | A1 | | 4/2007 |
| EP | 1 890 087 | A1 | | 2/2008 |
| EP | 1 953 464 | A1 | | 8/2008 |
| EP | 2 017 544 | A1 | | 1/2009 |
| EP | 2 716 982 | A2 | | 4/2014 |
| EP | 2 716 983 | A2 | | 4/2014 |
| JP | 05126351 | A | * | 5/1993 |
| JP | 2000-304347 | A | | 11/2000 |
| JP | 2004-076960 | A | | 3/2004 |
| JP | 2004-101056 | A | | 4/2004 |

* cited by examiner

INDOOR UNIT OF AIR CONDITIONER

CROSS-REFERENCE TO RELATED APPLICATION

The application claims priority under 35 U.S.C. § 119 and 35 U.S.C. § 365 to Korean Patent Application No. 10-2015-0114963, filed Aug. 13, 2015, whose entire disclosure is hereby incorporated by reference.

BACKGROUND

1. Field

An inside unit of an air conditioner is disclosed herein.

2. Background

Generally, an air conditioner is a cooling and heating system which heats and cools a room by repeatedly suctioning inside air, exchanging heat with a low temperature or high temperature refrigerant, and then discharging the heat-exchanged air into the room.

In particular, the air conditioner is divided into an outside unit (which may be referred to as an "outdoor side" or "heat radiating side") which is typically installed at an outside, and an inside unit (which may be referred to as an "inside side" or "heat absorbing side") which is typically installed at an inside of a dwelling or building. The outside unit typically includes a condenser (an outside heat exchanger) and a compressor, and an evaporator (an inside heat exchanger) is typically installed at the inside unit.

The air conditioner may be classified into a separate type air conditioner in which the outside unit and the inside unit are separately installed, and an integral type air conditioner in which the outside unit and the inside unit are integrally installed. The separate type air conditioner is typically preferred in consideration of an installation space, a noise, or the like.

In a multi-type air conditioner among the separate type air conditioners, a plurality of inside units are connected to one outside unit, and the inside units are installed at rooms to be air-conditioned, respectively, and thus an effect as if several air conditioners are installed may be obtained. Regarding the inside unit of such a multi-type air conditioner, an inside unit of a cassette type air conditioner which is installed at a ceiling of an inside space and heats and cools the inside space is commonly used.

A representative configuration of the cassette type air conditioner is disclosed in Korean Patent Publication No. 10-2009-0074374 ("374 Publication"), which is incorporated herein by reference. The '374 Publication discloses an inside unit of an air conditioner in which a pan assembly, a heat exchanger, a drain pan and a shroud are installed inside a cabinet, and which further includes a suction grille for shielding the cabinet and suctioning inside air, and a discharge port for discharging suctioned air.

The configuration disclosed in the '374 Publication has several disadvantages. The heat exchanger is seated on the drain pan. Therefore, when the drain pan must be separated or removed, the heat exchanger seated on the drain pan must also be disassembled. Also, because an entire load of the heat exchanger is supported by the drain pan, the drain pan may be damaged or separated. Furthermore, when air blown by rotation of a fan passes through the heat exchanger, discharge of the air may be concentrated to a certain section in a lengthwise direction of the discharge port. Therefore, in this configuration, it is not possible to provide an even and equal air volume at the entire discharge port. Additionally, when an air flow is concentrated to a local section, the air flow may be degraded, and thus a noise may be generated.

SUMMARY

The present disclosure is directed to providing an inside unit of an air conditioner, which is able to provide a stable supporting structure of a heat exchanger by a supporting guide and also to enhance flowability of air.

According to an aspect of the present disclosure, there is provide an inside unit of an air conditioner, including a cabinet that accommodates a fan, a heat exchanger, and a supporting guide, and a front panel attached to the cabinet, the front panel having a suction port through which inside air is suctioned and a panel outlet port through which heat-exchanged air is discharged, wherein the heat exchanger is arranged to surround a perimeter of the fan, and wherein the supporting guide is installed between the heat exchanger and the fan, and configured to guide the air discharged from the fan toward the panel outlet port.

According to another aspect of the present disclosure, there is provided an inside unit of an air conditioner, including a cabinet that accommodates a fan, a heat exchanger, and a supporting guide, and a front panel attached to the cabinet, the front panel having a suction port through which inside air is suctioned and a panel outlet port through which heat-exchanged air is discharged, wherein the heat exchanger is arranged to surround a perimeter of the fan, and wherein the supporting guide is installed between the heat exchanger and the fan, and configured to guide a flow of air and to restrict the heat exchanger.

According to another aspect of the present disclosure, there is provided an inside unit of an air conditioner, including a cabinet, a front panel configured to shield the cabinet, the front panel having a suction port through which inside air is suctioned and a panel outlet port through which heat-exchanged air is discharged, a fan provided at an inside of the cabinet, a heat exchanger provided inside the cabinet, the heat exchanger being disposed to surround a perimeter of the fan, a drain pan assembly provided at an opened surface of the cabinet, the drain pan assembly having a recessed portion formed at both side ends thereof so that an outlet port corresponding to the panel outlet port is formed by being coupled to the cabinet, a supporting guide provided between the fan and the heat exchanger, the supporting guide being fixed to a bottom surface of the cabinet to support a side of the heat exchanger, and a guide portion formed at the supporting guide, the guide portion extending toward the fan to guide air discharged from the fan to the outlet port.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION

Hereinafter, exemplary embodiments of the present disclosure will be described in detail with reference to the accompanying drawings. It is understood that the description herein is not intended to limit the claims to the specific embodiments described. On the contrary, it is intended to cover alternatives, modifications, and equivalents as may be included within the spirit and scope of the present disclosure.

Figure 1:
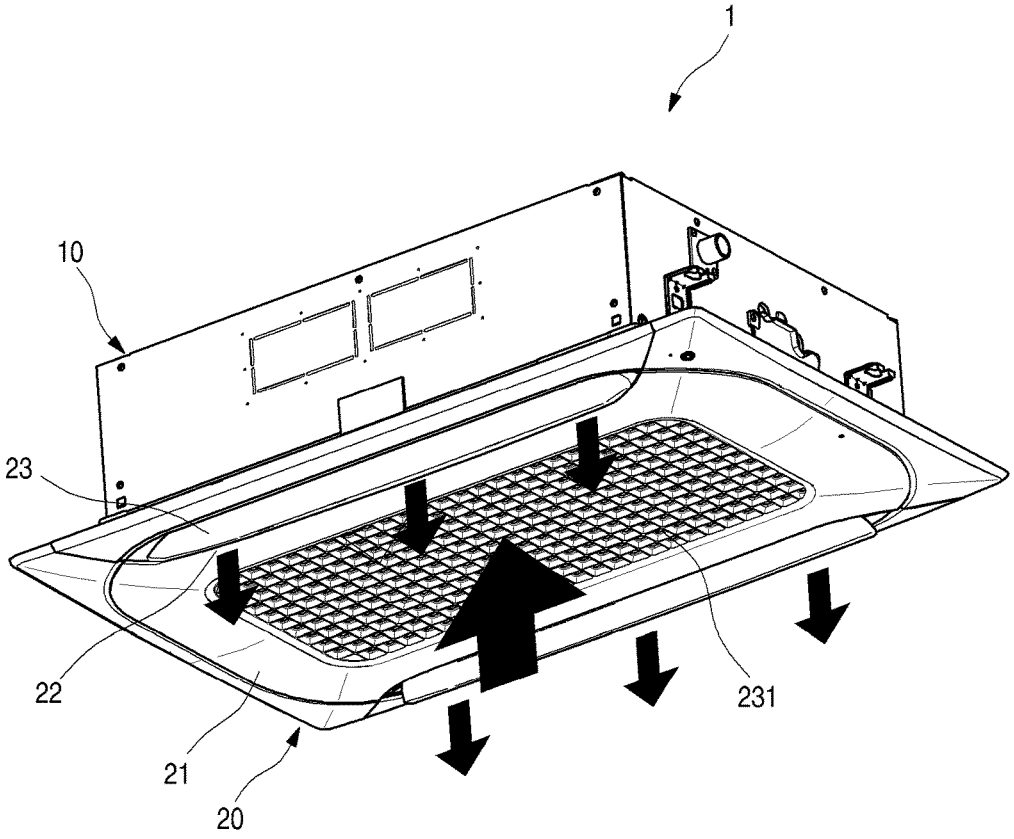
FIG. 1 is a perspective view of an inside unit of an air conditioner according to an embodiment of the present disclosure.
Figure 2:
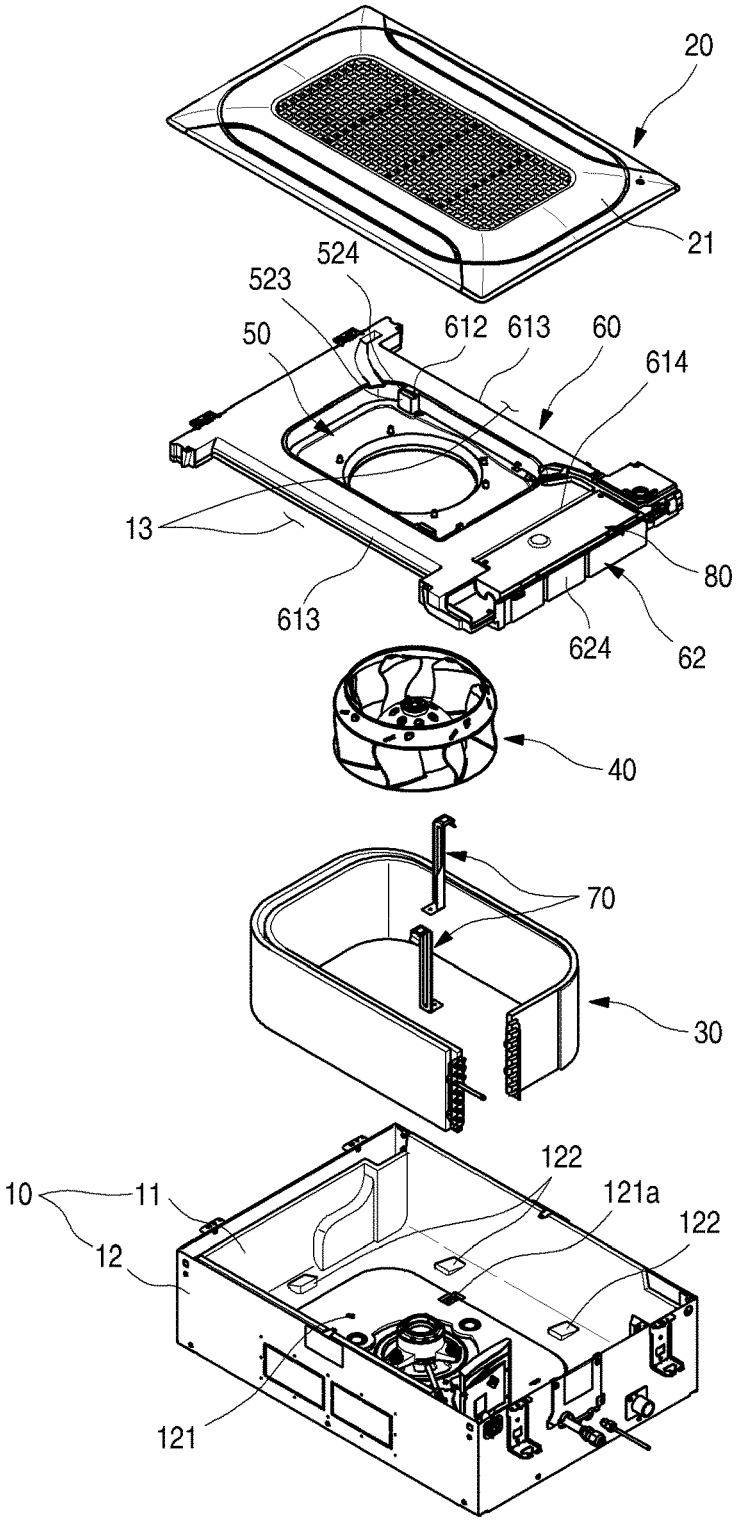
FIG. 2 is an exploded perspective view of the inside unit.

FIG. 1 is a perspective view of an inside unit of an air conditioner according to an embodiment of the present disclosure. FIG. 2 is an exploded perspective view of the inside unit As illustrated in FIGS. 1 and 2, an inside unit 1 of an air conditioner (hereinafter, referred to as an "inside unit") may include a cabinet 10 which is inserted inside or at a ceiling of an inside space, and a front panel 20 and a suction grille 21 which are provided at a lower end of the cabinet 10 and exposed to a lower side of the ceiling when the inside unit is installed.

The cabinet 10 may accommodate a heat exchanger 30 which exchanges heat with suctioned air, a fan 40 which forcibly suctions and discharges inside air, an orifice member 50 which guides the air suctioned toward the fan 40, a drain pan assembly 60 which collects condensate generated from the heat exchanger 30, and a drain pump (not shown) which discharges the collected condensate to an outside.

As illustrated, the front panel 20 may be installed at the lower end of the cabinet 10, and may have an approximately quadrangular shape when viewed from a bottom. The front panel 20 may protrude further outward than the lower end of the cabinet 10 such that a perimeter of the front panel 20 is in contact with a lower surface of the ceiling.

The front panel 20 may include a panel outlet port 22 which serves as an exit of the air discharged through the cabinet 10. The panel outlet port 22 may be formed at each of both side locations of the front panel 20 which face each other, and may be formed at each of locations corresponding to outer ends of the cabinet 10. The panel outlet port 22 may be disposed in a lengthwise direction of the front panel 20, and may be formed to be opened and closed by a vane 23 installed at the front panel 20.

The suction grille 21 may be provided at a center portion of the front panel 20, and may form a part of an exterior of a lower surface of the inside unit 1. The suction grille 21 may be located between one pair of panel outlet ports 22, and may be formed in a plate-like shape to shield an opening formed at the center portion of the front panel 20.

The suction grille 21 is configured to form a passage for the air which is introduced into the inside unit 1. For example, at least a part of the suction grille 21 may be formed in a grille or grid-like shape, and may form a plurality of suction ports 231 so that the inside air is efficiently introduced.

The cabinet 10 may further include an outer plate 11 which forms an exterior thereof, and an inner case 12 which is provided inside the outer plate 11.

The outer plate 11 may be formed so that an exterior of the cabinet 10 of which a low surface is opened. Additionally, the outer plate 11 may be formed of a steel material having a plate-like shape. The outer plate 11 may be formed by coupling elements forming each of surfaces thereof, and may also be formed to be bent and thus to have at least one or more surfaces.

The inner case 12 is provided at an inner side surface of the outer plate 11. The inner case 12 may be formed of an insulating material such as expanded polystyrene (EPS), so as to insulate an inside of the cabinet 10 and to prevent noise and vibration. As illustrated in FIG. 2, the inner case 12 may be arranged in close proximity with the outer plate 11, and form an internal shape of the cabinet 10. The inner case may be configured so that a surface thereof which is in contact with the front panel 20 is completely opened.

The fan 40 may be provided at an internal space of the inner case 12. The heat exchanger 30 may be disposed around the fan 40. More particularly, the heat exchanger 30 may be disposed along an inner side surface of the inner case 12, and formed to be spaced apart from a wall surface of the inner case 12 and the fan 40.

Therefore, the air which is suctioned in an axial direction of the fan 40 may be discharged while being rotated in a circumferential direction of the fan 40, and may exchange heat with a refrigerant while passing through the heat exchanger 30.

The drain pan assembly 60 may be installed at an opened surface of the cabinet 10. The drain pan assembly 60 may function to shield the opened surface of the cabinet 10. More particularly, the drain pan assembly 60 may be configured to seat on an upper end of the inner case 12.

As illustrated in FIG. 2, by installing the drain pan assembly 60, outlet ports 13 which are in communication with the panel outlet ports 22 and through which the heat-exchanged air is discharged may be defined at both sides of the cabinet 10, respectively. Additionally, a suction port which is opened so that the air suctioned through the suction grille 21 flows toward the fan 40 may be formed at a center of the drain pan assembly 60.

The drain pan assembly 60 may include a body 61, a pan plate 62 which forms a surface directed toward an inside of the inner case 12, and the orifice member 50 which is provided at a center of the body 61.

The body 61 may be made of the same material as that of the inner case 12, and may insulate the inside of the cabinet 10. Additionally, the body 61 may form the entire shape of the drain pan assembly 60.

The orifice member 50 may be provided at the center of the body 61, and a panel inserting portion 612 may be formed at one side thereof, at which the body 61 and the orifice member 50 are in contact with each other, to be recessed. The panel inserting portion 612 may be formed at a location corresponding to a panel fixing portion 523 formed at the orifice member 50 when the orifice member 50 is installed, and form a space in which a panel coupling portion 202 of the front panel 20 is inserted.

The orifice member 50 may be installed at an opened center of the body 61. The orifice member 50 may be injection-molded of a plastic material. An orifice hole 51 is formed at a center of the orifice member 50. The suctioned air passes through the orifice hole 51 and flows toward the fan 40.

A flange having a predetermined height may be formed at a perimeter of a bottom surface of the orifice member 50, and the panel fixing portion 523 may be formed at a location of the flange of the orifice member 50 corresponding to the panel inserting portion 612.

By installing the orifice member 50 at the body 61, the panel inserting portion 612 and the panel fixing portion 523 may form a coupling portion inserting port 524, and the panel coupling portion 202 may be inserted through the coupling portion inserting port 524, and may be coupled with (e.g., hooked to) and restricted by the panel fixing portion 523. Therefore, the front panel 20 has a structure which is attached to one side of the drain pan assembly 60.

A recessed portion 613 which is recessed inward may be formed at each of both side surfaces of the body 61. The recessed portion 613 may form the outlet ports 13 when the drain pan assembly 60 is installed. A box accommodating portion 614 for providing a space in which a control box 80 is disposed may be further formed at another side surface of the body 61.

The pan plate 62 may be provided at a lower side of the body 61. The pan plate 62 may accommodate a lower portion of the body 61, and form an entire lower surface of the drain pan assembly 60. The pan plate 62 may be formed of a different plastic material from that of the body 61. Additionally, the pan plate 62 may form an exterior of the lower surface of the drain pan assembly 60 and may be formed to protect the body 61.

The pan plate 62 may have a structure in which the body 61 is coupled to the pan plate 62 after being injection-molded of a plastic material. Also, the pan plate 62 may be formed by an insert injection molding when the body 61 is molded. Also, the pan plate 62 and the body 61 may be integrally formed of the same material.

A space in which the condensate is collected may be formed at the pan plate 62. The space may be provided at a suctioning side of the drain pump so that the collected condensate can be suctioned and discharged. Additionally, a heat exchanger accommodating portion in which an end of the heat exchanger 30 is accommodated may be formed at the pan plate 62 to be recessed.

A box seating portion 624 which is disposed at a side of the box accommodating portion 614 when being coupled to the body 61 and on which the control box 80 is seated may be further formed at one side of the pan plate 62. The control box 80 may be exposed to a panel opening 24 of the front panel 20 when the suction grille 21 is opened in a seated state on the box seating portion 624.

Figure 3:
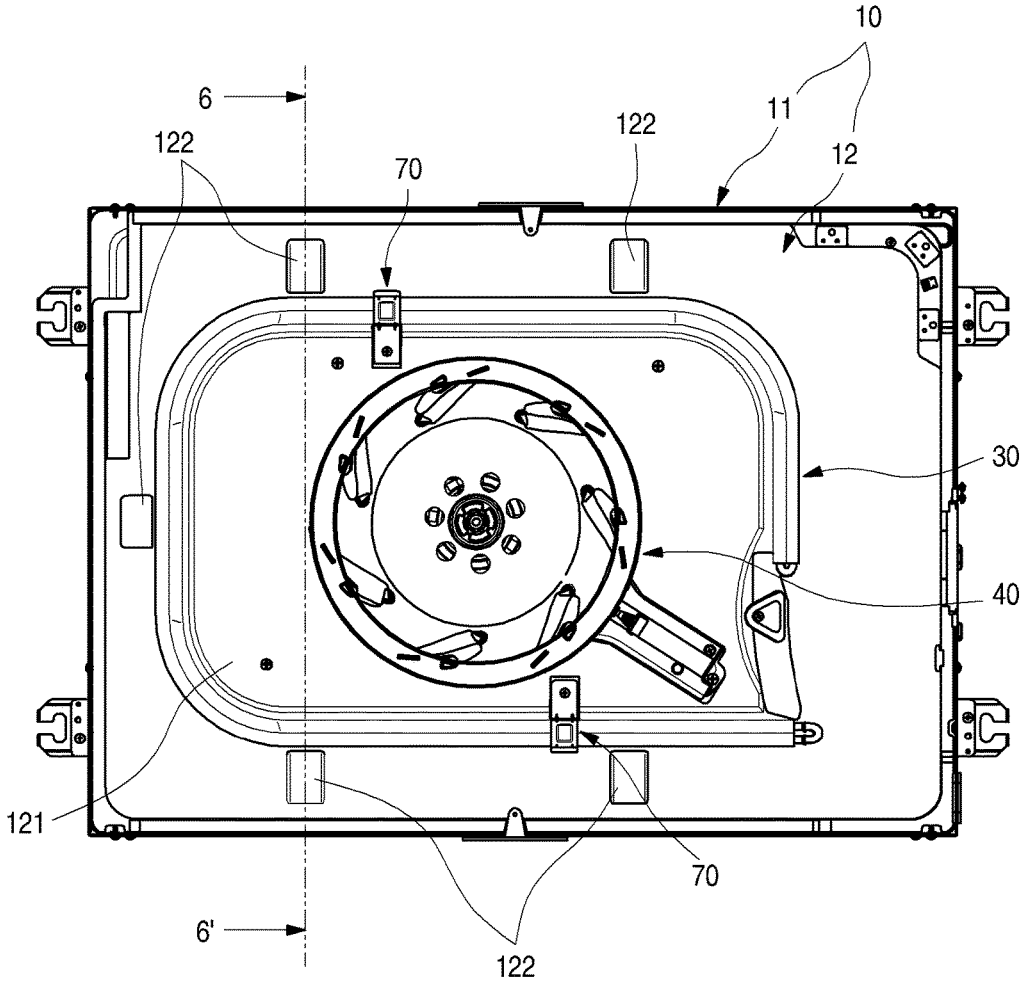
FIG. 3 is a plan view illustrating an internal structure of a cabinet according to the embodiment of the present disclosure.

FIG. 3 is a plan view illustrating an internal structure of the cabinet according to the embodiment of the present disclosure. As illustrated in FIG. 3, the outer plate 11 is provided in contact with an outer side surface of the inner case 12, and forms an exterior surface of the cabinet 10.

The fan 40 is provided inside the inner case 12. The fan 40 suctions axially the air through the orifice member 50, and discharges the air in a circumferential direction. The air discharged by the fan 40 may pass through the heat exchanger 30.

A bottom surface of the inner case 12 may be formed with a heat exchanger installing portion 121 and a heat exchanger fixing portion 122 at which the heat exchanger 30 is disposed to be fixed thereto.

The heat exchanger installing portion 121 may protrude in a shape corresponding to that of an inner side surface of the heat exchanger 30. The heat exchanger installing portion 121 may be in contact with the inner side surface of the heat exchanger 30, and may support the heat exchanger 30 at an inside thereof.

The heat exchanger fixing portion 122 may protrude from one side which is distant from the heat exchanger installing portion 121, and to be in contact with an outer side surface of the heat exchanger 30. The heat exchanger 30 may include a plurality of heat exchanger fixing portions 122.

More particularly, for example, the heat exchanger 30 may have a structure which is seated at the bottom surface of the inner case 12 and also inserted between the heat exchanger installing portion 121 and the heat exchanger fixing portion 122. Therefore, the heat exchanger 30 may be disposed at an exact location inside the inner case 12, and one end thereof may be fixed by the heat exchanger installing portion 121 and the heat exchanger fixing portion 122.

A supporting guide 70 which fixes the heat exchanger 30 and also guides a flow of the air blown by the fan 40 may be provided at the inner case 12 inside the heat exchanger 30. More particularly, the supporting guide 70 may be provided at the heat exchanger installing portion 121 of the inner case 12. A pair of supporting guides 70 may be provided at locations facing each other to fix both sides of the heat exchanger 30, and each of the supporting guides 70 may be provided at the side surface corresponding to a location at which the panel outlet port 22 is formed. It is understood that the number of the supporting guides 70 may be changed according to a length of the panel outlet port 22, and the same number of supporting guides 70 may be provided at each of both sides corresponding to the panel outlet port 22.

The supporting guide 70 may be provided at a location spaced apart from a center of the fan 40 at a predetermined distance to prevent the air blown by the fan 40 from being locally concentrated. Additionally, the supporting guides 70 disposed at the locations facing each other may be disposed in opposite directions to each other relative to the center of the fan 40.

Figure 4:
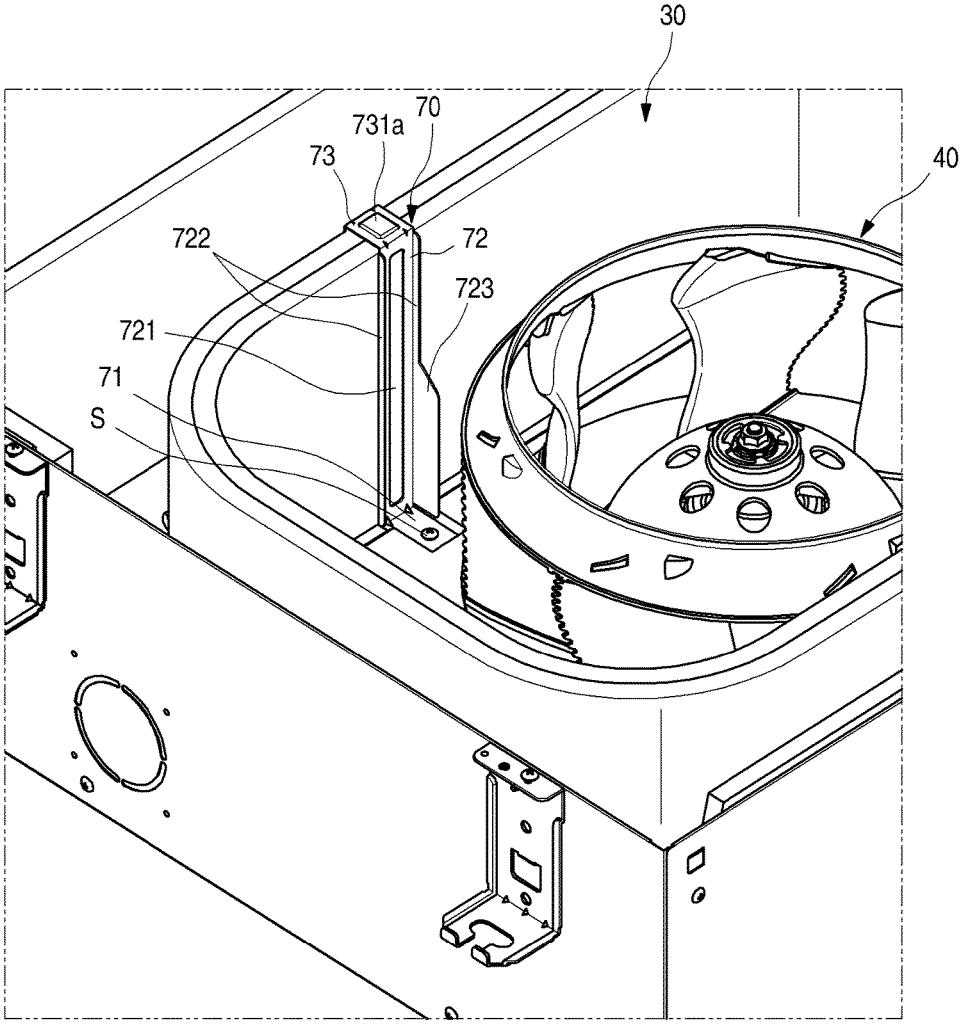
FIG. 4 is a partial perspective view illustrating a state in which a supporting guide according to the embodiment of the present disclosure is installed.
Figure 5:
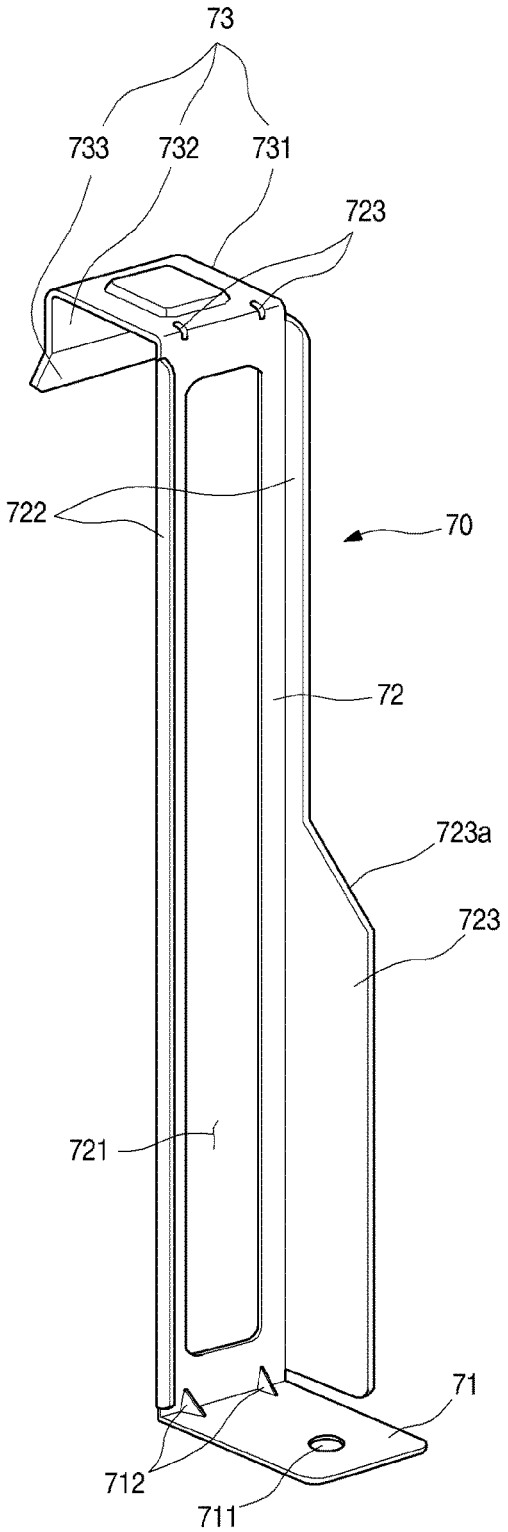
FIG. 5 is a perspective view of the supporting guide.

FIG. 4 is a partial perspective view illustrating a state in which the supporting guide is installed according to the embodiment of the present disclosure. FIG. 5 is a perspective view of the supporting guide.

As illustrated in FIGS. 4 and 5, each of the supporting guides 70 may be entirely formed of a plate-shaped metallic material, and may be formed to fix and install the heat exchanger 30 and to guide the flow of the air discharged by the fan 40 by sheet metal machining and bending.

More specifically, each of the supporting guides 70 may include a base portion 71, an extension portion 72 and a fixing portion 73.

The base portion 71 may form a lower surface of the supporting guide 70, and enable the supporting guide 70 to be installed at the inner case 12. A coupling hole 711 may be formed at the base portion 71. A fastening member S, such as a screw or a bolt, may be fastened to the coupling hole 711 so that the base portion 71 is fixed and coupled to an upper surface of the heat exchanger installing portion 121 of the inner case 12.

The extension portion 72 may be formed at one end of the base portion 71. More particularly, as shown, the extension portion 72 may be formed to be bent vertically upward from an end of the base portion 71. A reinforcing portion 712 may be formed at a corner between the base portion 71 and the extension portion 72.

The reinforcing portion 712 functions to prevent the extension portion 72 or the base portion 71 from being deformed (e.g., curved or bent due) to a weight or load. The reinforcing portion 712 may be formed to connect the extension portion 72 with a lower end of the base portion 71. The reinforcing portion 712 may formed as a separate molded member to be attached, or may be formed to be recessed or to protrude by machining the corner between the base portion 71 and the extension portion 72.

The extension portion 72 connects the base portion 71 and a fixing portion 73 together. The extension portion 72 may be formed to have a height corresponding to that of the heat exchanger 30. The extension portion 72 may be formed to be in contact with the inner side surface of the heat exchanger 30, and a most area inside the extension portion 72 may be formed to be opened by an extension portion opening 721.

Therefore, through the extension portion opening 721, the blown air may pass through the heat exchanger 30 covered by the extension portion 72, and thus may exchange heat. Accordingly, an area of the heat exchanger 30 which is covered by installation of the supporting guide 70 may be minimized, and thus a heat exchange loss may also be minimized.

Side ribs 722 may be further formed at both of left and right ends of the extension portion 72, respectively. The side ribs 722 are formed by bending each of left and right side surfaces of the extension portion 72 in one direction, and also formed to extend from an upper end of the extension portion 72 to a lower end thereof. Each of the side ribs 722 may be formed having a predetermined width and thus to perform a function of reinforcing strength of the extension portion 72. Therefore, even though a load is applied to the extension portion 72, the extension portion 72 will not bend or deform.

A guide portion 723 may be formed at the side rib 722 of one of both sides of the extension portion 72 close to the fan 40. The guide portion 723 may extend upward from a lower end of the side rib 722. The guide portion 712 may extend to a middle portion of a vertical height of the extension portion 72, and thus guide the flow of the air.

The guide portion 723 functions to restrict the flow of some of the air guided by the fan 40. The guide portion 723 also prevents the air flow from being concentrated to a local location of the heat exchanger 30, to enable the air to evenly pass through the entire heat exchanger 30, and enable the air volume of the heat-exchanged air discharged to the panel outlet port 22 to be uniform.

The guide portion 723 may extend upward to have a uniform width, and an inclined portion 723*a* which is formed to be inclined may be formed at an upper end thereof. The guide portion 723 may be disposed perpendicular relative to the extension portion 72 When the side ribs 722 are not formed, the guide portion 723 may be formed to directly protrude from a side surface of the extension portion 72.

The fixing portion 73 may be formed at the upper end of the extension portion 72. The fixing portion 73 may be bent so as to accommodate and fix an upper end of the heat exchanger 30 at the upper end of the extension portion 72.

More particularly, the fixing portion 73 may include an upper part 731 which presses and fixes the upper end of the heat exchanger 30, and an outer part 732 which presses and fixes the outer side surface of the heat exchanger 30. The upper end of the heat exchanger 30 may be accommodated at the fixing portion 73 by the upper part 731 and the outer part 732.

A reinforcing portion 723 may be formed between the upper part 731 and the extension portion 72. The reinforcing portion 723 may have the same shape and structure as those of the reinforcing portion 712 formed between the base portion 71 and the extension portion 72.

A recessed portion 731*a* which is recessed upward may be further formed at the upper part 731. As shown, the recessed portion 731*a* is recessed upward from a center of the upper part 731, and prevents a deformation of the upper part 731.

The outer part 732 may extend downward from an extending end of the upper part 731, and be in close contact with the outer side surface of the heat exchanger 30. An entrance portion 733 may be formed at a lower end of the outer part 732. The entrance portion 733 may be bent outward from the lower end of the outer part 732 at a predetermined angle, and may be formed so that an entrance of the fixing portion 73 is wider. Therefore, when the supporting guide 70 is installed, the upper end of the heat exchanger 30 may be easily inserted into the fixing portion 73.

Hereinafter, an assembling process of the supporting guide of the inside unit of the air conditioner having the above-described structure will be described.

Figure 6:
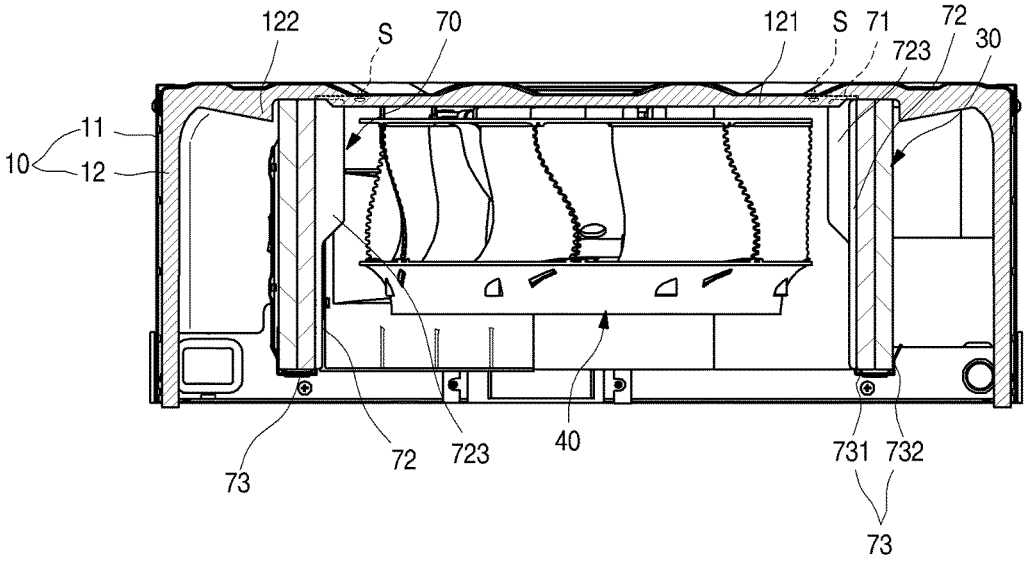
FIG. 6 is a cross-sectional view taken along line 6-6' of FIG. 3.

FIG. 6 is a cross-sectional view taken along line 6-6' of FIG. 3. As illustrated in FIG. 6, the heat exchanger 30 is fixed to the inner case 12 by the heat exchanger installing portion 121 and the heat exchanger fixing portion 122. And in this state, the heat exchanger 30 may be completely fixed to and installed at the inside of the inner case 12 by installing the supporting guide 70.

To install the supporting guide 70, first, the upper end of the heat exchanger 30 is inserted and accommodated in the fixing portion 73 while the supporting guide 70 is disposed at an installation location.

In this state, the fixing portion 73 accommodates the upper end of the heat exchanger 30, and the extension portion 72 is in close contact with the inner side surface of the heat exchanger 30. And the base portion 71 is moved to a set location on the heat exchanger installing portion 121. A recessed installation portion 121*a* which is recessed in a shape corresponding to the base portion 71 may be formed at one side of the heat exchanger installing portion 121 at which the base portion 71 is located, and thus the supporting guide 70 may be positioned at an exact location. The supporting guide 70 may be fixed to and installed at the inner case 12 by fastening the fastening member S to the coupling hole 711 of the base portion 71.

A pair of supporting guides 70 may be provided at locations facing each other to support the heat exchanger 30 from both sides of the inner case 12, and thus to enable the heat exchanger 30 to be fixed to the inside of the cabinet 10. As illustrated in FIG. 6, the heat exchanger 30 may be fixed while being suspended inside the cabinet 10 by the supporting guides 70, and even when the drain pan assembly 60 is disassembled to perform a service operation inside the cabinet 10, the heat exchanger 30 may be stably maintained in an installed state.

Meanwhile, the supporting guides 70 may simultaneously perform a supporter function of fixing the heat exchanger 30 and a function of guiding the flow of the air directed outward from an inside of the heat exchanger 30. Thus, the supporting guide 70 may have various installation structures other than the structure disclosed in the previous embodiment.

For example, in the previous embodiment, the supporting guide 70 is installed at the inner case 12. However, the supporting guide 70 may be fixed to the outer plate 11 according to a structure of the inner case 12. Also, when the inner case 12 is molded, the supporting guide 70 may be integrally formed together to have the above-described shape.

The supporting guides 70 may have different configurations such that a part of one of the supporting guides 70 is be configured to fix the heat exchanger 30, and a part of the other of the supporting guides 70 is configured to guide the flow of the air. One of the supporting guide 70 configurations may be integrally formed with the inner case 12.

Figure 7:
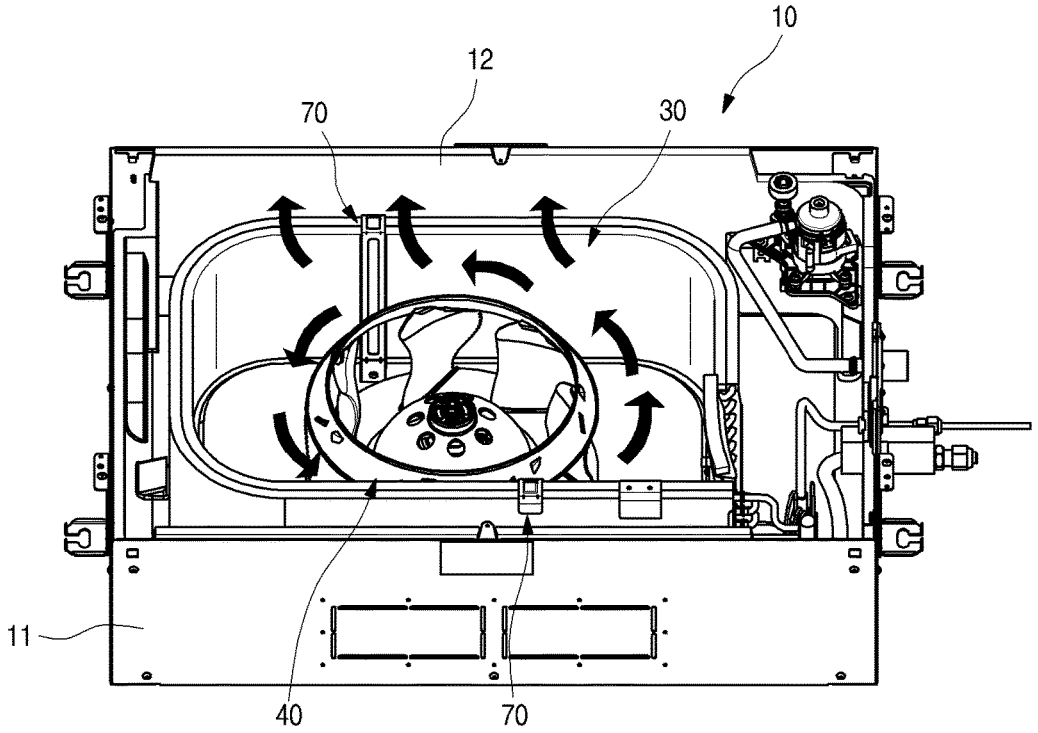
FIG. 7 is a view illustrating an air flowing state in the cabinet.
Figure 8:
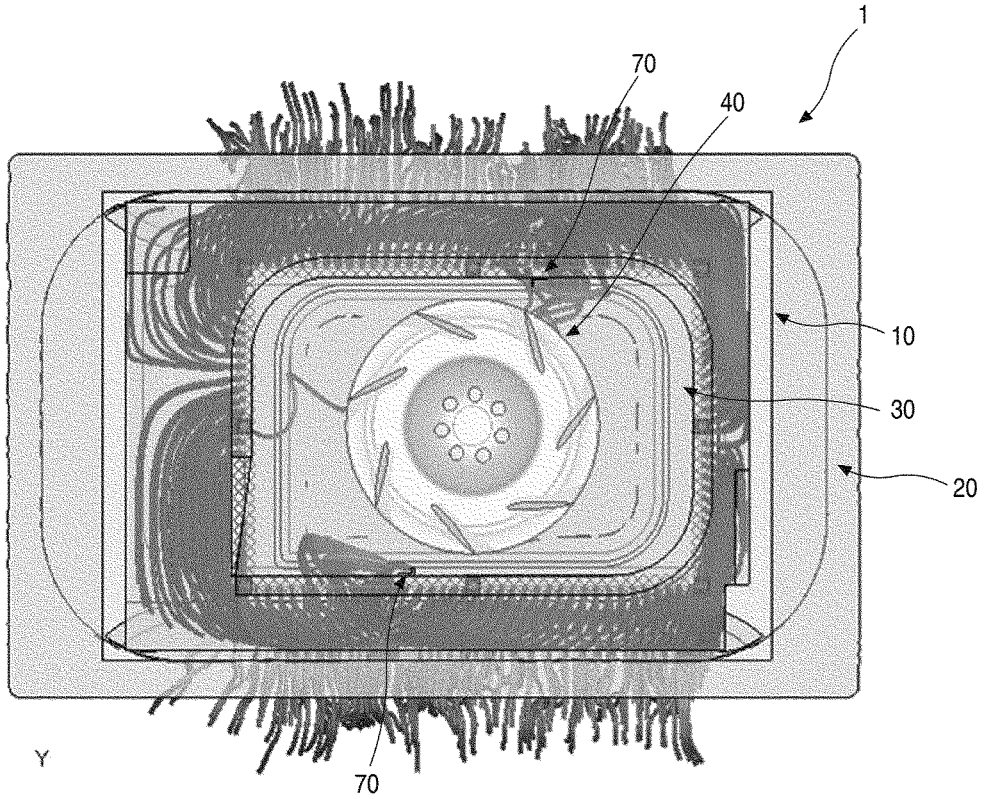
FIG. 8 is a view illustrating a state in which an air flow in the cabinet is simulated.

Hereinafter, an operation of the inside unit of the air conditioner having the above-described structure will be described with respect to FIGS. 7 and 8. FIG. 7 is a view illustrating an air flowing state in the cabinet. FIG. 8 is a view illustrating a state in which the air flow in the cabinet is simulated.

As illustrated in FIGS. 7 and 8, when an operation of the inside unit 1 starts, the fan 40 is rotated by driving of a fan motor. The air in an inside space is then suctioned toward the center of the fan 40 through the suction grille 21, and the suctioned air is discharged while being rotated in the circumferential direction of the fan 40, exchanges heat while passing through the heat exchanger 30, and then is discharged to the inside space through the panel outlet port 22.

Meanwhile, the air suctioned to the inside of the cabinet 10 by the fan 40 is discharged in the circumferential direction of the fan 40. At this point, the air discharged by the fan 40 passes through the heat exchanger 30.

Some of the air blown toward the heat exchanger 30 and flowing along the heat exchanger 30 by the guide portion 723 formed at the supporting guide 70 may be blocked by the guide portion 723, and pass through the heat exchanger 30.

That is, the air which forcibly flows by the fan 40 may be concentrated to a certain section of the heat exchanger 30 base on the configuration and arrangement of the fan 40 which blows the air while being rotated and the panel outlet ports 22 disposed at both sides. However, by the supporting guide 70, some of the flowing air is guided to pass through the heat exchanger 30 before the section to which the air is concentrated.

As a result, the air flowing inside the cabinet 10 evenly passes through the entire heat exchanger 30. The result of a computational fluid dynamics (CFD) analysis shows that an even air flow occurs at the entire heat exchanger 30, and the heat-exchanged air having an even air volume may be discharged from the panel outlet ports 22 formed at both sides to the inside space.

According to the present disclosure having the above-described configuration, the following effects can be expected.

First, because the supporting guide for fixing the heat exchanger is provided inside the cabinet, the heat exchanger can be maintained in a fixed state to the inside of cabinet even when the drain pan assembly is disassembled to perform a service operation in the cabinet. Therefore, when the service operation in the cabinet or the service operation of the drain pan assembly is performed, only the drain pan assembly can be disassembled without disassembling of the entire cabinet, and thus workability can be enhanced.

Second, the heat exchanger can be provisionally fixed by the heat exchanger installing portion and the heat exchanger fixing portion formed at the bottom surface of the inner case, and can be additionally fixed to the inside of the inner case by the supporting guides. Because the structure which is supported by the drain pan assembly is also provided, the heat exchanger can be stably supported, and the load applied to the drain pan assembly can be reduced, and thus stability and durability can be enhanced.

Third, the supporting guides are formed at the side surfaces corresponding to locations of the panel outlet ports, and the guide portion is formed at the supporting guide, and thus the air radially blown by the fan can evenly pass through the heat exchanger, and the air volume discharged through the panel outlet ports can also be uniform in an entire length of the discharge port. Therefore, cooling efficiency in the heat exchanger can be improved, and the air volume prevented from being concentrated to a local area, and thus the noise can be prevented.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An inside unit of an air conditioner, comprising:

a cabinet that accommodates a fan, a heat exchanger, and a supporting guide;

a front panel attached to the cabinet, the front panel having a suction port through which inside air is suctioned and a panel outlet port through which heat-exchanged air is discharged; and a drain pan assembly provided at an opened surface of the cabinet, the drain pan assembly having a recessed portion formed at both side ends thereof so that an outlet port corresponding to the panel outlet port is formed by being coupled to the cabinet, wherein the panel outlet port is formed at an outer side of the front panel further than the heat exchanger, wherein the heat exchanger is arranged to surround a perimeter of the fan, and wherein the supporting guide is installed between the heat exchanger and the fan, and configured to guide a flow of air and to restrict the heat exchanger, and wherein the supporting guide comprises:

a base portion that contacts a bottom surface of the cabinet and is coupled to bottom surface, an extension portion that extends from the base portion and is in contact with a side surface of the heat exchanger, and a fixing portion that is formed at an end of the extension portion and coupled to the heat exchanger, and wherein the extension portion includes a planar guide portion that protrudes toward the fan and guides the air discharged from the fan toward the heat exchanger, and wherein both sides of the extension portion are respectively formed with a side rib that is bent in a lengthwise direction of the extension portion, and the guide portion is formed at the side rib that is located closer to the fan, wherein the guide portion extends upward from a lower end of the side rib, wherein the guide portion does not extend beyond the middle of a vertical height of the extension portion, wherein the guide portion extends upward and has a uniform width, and wherein an inclined portion which is formed to be inclined is formed at an upper end of the guide portion.

2. The inside unit of claim 1, wherein a reinforcing portion that prevents a deformation of the supporting guide is formed on the supporting guide by recessing or protruding a corner of the supporting guide located between the base portion and the extension portion.

3. The inside unit of claim 1, wherein the extension portion includes an extension portion opening formed therein.

4. The inside unit of claim 1, wherein the fixing portion comprises an upper part that is bent from an end of the extension portion and coupled to an end of the heat exchanger, and an outer part that is bent from an end of the upper part and forms a space to accommodate the end of the heat exchanger.

5. The inside unit of claim 4, wherein the outer part includes an entrance portion formed at an end thereof that is bent outward to accommodate the heat exchanger.

6. The inside unit of claim 4, wherein the upper part includes a recessed portion that is recessed upward to prevent a deformation of the upper part.

7. The inside unit of claim 1, wherein the cabinet includes an installing portion formed at an inner side surface thereof, the installing portion having a shape that corresponds to a shape of the base portion, whereby the base portion is coupled to the installing portion.

8. The inside unit of claim 1, wherein the cabinet comprises an outer plate and an inner case that is in contact with the outer plate and forms an inside of the cabinet, and a heat exchanger installing portion formed at the inner case, the heat exchanger installing portion being in contact with an inner side surface of the heat exchanger and having an inner space at which the heat exchanger is disposed.

9. The inside unit of claim 8, wherein the inner case comprises a plurality of heat exchanger fixing portions that protrude to locations spaced apart from the heat exchanger installing portion, the heat exchanger fixing portions being disposed along the heat exchanger and provided to support an outer side surface of the heat exchanger.

* * * * *